US005181495A

United States Patent [19]

Gschwend et al.

[11] Patent Number: 5,181,495

[45] Date of Patent: Jan. 26, 1993

[54] INTERNAL COMBUSTION POWERED DEVICE FOR SETTING FASTENING ELEMENTS

[75] Inventors: Hans Gschwend, Mauren, Switzerland; Johann Buechel, Sevelen, Austria

[73] Assignee: Hilti Aktiengesellschaft, Furstentum, Liechtenstein

[21] Appl. No.: 769,296

[22] Filed: Oct. 1, 1991

[30] Foreign Application Priority Data

Oct. 11, 1990 [DE] Fed. Rep. of Germany ..... 4032202

[51] Int. Cl.[5] ..... B25C 1/08

[52] U.S. Cl. ..... 123/46 SC; 60/632

[58] Field of Search ..... 123/46 SC, 46 H; 60/632, 633

[56] References Cited

U.S. PATENT DOCUMENTS

| | | | |
|---|---|---|---|
| 4,109,475 | 8/1978 | Schnell | 123/46 H |
| 4,200,213 | 4/1980 | Liesse | 123/46 SC |
| 4,365,471 | 12/1982 | Adams | 60/633 |
| 4,377,991 | 3/1983 | Liesse | 123/46 SC |
| 4,721,240 | 1/1988 | Cotta | 123/46 SC |
| 4,739,915 | 4/1988 | Cotta | 123/46 SC |
| 4,759,318 | 7/1988 | Adams | 123/46 SC |
| 4,773,581 | 9/1988 | Ohtsu et al. | 123/46 SC |
| 4,905,634 | 3/1990 | Veldman | 123/46 SC |

*Primary Examiner*—David A. Okonsky

*Attorney, Agent, or Firm*—Anderson Kill Olick & Oshinsky

[57] ABSTRACT

A portable, internal combustion powered work device, such as a device for setting or driving fastening elements into a receiving material, includes a combustion chamber (9) wherein an air-fuel mixture is ignited. A guide cylinder (8) and a piston (7) are axially displaceably guided within the combustion chamber. When the air-fuel mixture is ignited, the piston (7) is driven and, in turn, drives a fastening element into the receiving material. Following the ignition of the air-fuel mixture and the driving of the fastening element, the combustion chamber volume is reduced to approximately zero, whereby a purely mechanical clearing of the combustion chamber is effected without the necessity of an additional flushing air flow.

9 Claims, 3 Drawing Sheets

INTERNAL COMBUSTION POWERED DEVICE FOR SETTING FASTENING ELEMENTS

BACKGROUND OF THE INVENTION

The present invention is directed to a portable, internal combustion powered work device, such as a device for setting fastening elements into a receiving material including an axially extending combustion chamber for receiving an air fuel mixture to be ignited therein. An axially extending guide cylinder is located within and axially displaceable relative to the combustion chamber and an axially extending piston is displaceably guided in the guide cylinder.

Such a work device is disclosed in U.S. Pat. No. 4,759,318.

This known work device has a cylindrically shaped combustion chamber divided into a rear partial combustion chamber and a front partial combustion chamber relative to the setting direction. The chambers communicate with one another via a check valve which permits flow from the rear chamber to the front chamber. Front partial combustion chamber has a central opening on its front side covered by a differential piston which encloses the combustion chamber coaxially at the outside. When an air-fuel mixture is ignited in the combustion, chamber the differential piston moves forwardly away from the combustion chamber and compresses the air located in front of it, the air is stored in a supply tank. The compressed air is used, on one hand, for moving the piston rearwardly, since the vacuum pressure required for such movement, which is already present in the combustion chamber, is not sufficient due to the combustion residues present in the chamber, and on the other hand, for the required opening of the check valve by means of a tappet, as well as for opening an exhaust gas duct for flushing the combustion chamber. Flushing the combustion chamber is effected by air sucked in above the differential piston and pressed into the combustion chamber through a flushing duct located between the combustion chamber and the differential piston as the piston is guided rearwardly. After completion of the rearward guiding of the differential piston and the flushing of the combustion chamber, the exhaust gas duct is closed and the combustion chamber receives compressed air from the supply tank flowing through the flushing duct. Since the combustion chamber has received a new supply of fuel, an air-fuel mixture is now located in the combustion chamber and can be ignited for again moving the differential piston.

As mentioned above, the combustion residues are flushed from the combustion chamber by an additionally produced air flow, accordingly, a flushing gas volume is required which is greater than the combustion chamber volume, since the interior of the differential piston must be flushed first. Therefore, this known work device requires a relatively large volume and a complicated air flow flushing system.

SUMMARY OF THE INVENTION

The primary object of the present invention is to provide a work device of the type described above so that combustion residues can be removed from the chamber without introducing an additional air flow.

A portable, internal combustion powered work device, in accordance with the present invention, is arranged so that the combustion chamber volume can be reduced at least approximately to zero after the combustion of the air-fuel mixture.

The combustion residues can be displaced out of the combustion chamber in a simple manner by this reduction of the combustion chamber volume to a value close to zero without requiring an additional air flow for flushing the combustion chamber. Accordingly, the work device of the present invention does not require an air flow flushing system, whereby a simpler construction is achieved.

To reduce the combustion chamber volume, it is possible, in principle, to displace opposite walls of the combustion chamber until they practically contact one another. In an advantageous arrangement, the reduction of the combustion chamber volume is effected with a combustion chamber wall having a through opening which can be closed by the piston.

Such an annular combustion chamber wall on the piston side can be the front wall of a cylinder combustion chamber. The combustion chamber wall receives the piston or a part thereof in its through opening, and after the ignition of the air-fuel mixture in the combustion chamber, the piston is displaced out of the opening in this combustion chamber wall. After the return of the piston, it closes the through opening and preferably moves together with the combustion chamber wall to reduce the combustion chamber volume. As a result, the movement of the piston and the combustion chamber wall are the same and this results in a even simpler construction of the work device. It is also possible to replace the displaceable combustion chamber wall completely by a piston end face. In such an arrangement, the guide cylinder could be formed by a part of the combustion chamber.

In one embodiment of the invention, at least one displaceable dividing wall provides the reduction of the combustion chamber volume and such wall divides the combustion chamber, as viewed in the setting direction, into a rear partial combustion chamber and a front partial combustion chamber with the rear chamber communicating with the front chamber.

Accordingly, the reduction of the combustion volume can be effected by a simple sequence of movements when the dividing wall is present.

The operation of the aforementioned dividing wall has been described extensively in U.S. Pat. Nos. 4,759,318 and 4,365,471 and, therefore, is not discussed here.

A second dividing wall, designated herein as an intermediate wall, serves to divide the rear partial combustion chamber into at least two separate rear partial chambers in communication with one another. This second dividing wall is also displaceable in the same direction as the combustion chamber wall for reducing the chamber volume, whereby a simple reduction of the combustion chamber volume is possible when such an intermediate wall is used.

The aforementioned intermediate wall has passages or ducts in its circumferential region for connecting the two rear partial chambers. Such intermediate wall serves to deflect the flame front after the ignition of the air-fuel mixture in the trailing rear partial chamber, as viewed in the setting direction, along its circumferential region for increasing the pressure in the leading rear partial chamber, as viewed in the setting direction, prior to the ignition of the air-fuel mixture contained therein, accompanied by compression of the air-fuel mixture in the leading rear partial chamber. In an advantageous feature of the invention, the combustion chamber wall has at least one exhaust gas duct so that it is possible for gas to exit the combustion chamber only when the combustion chamber wall is displaced for reducing the chamber volume.

Moreover, spacer elements are provided in the region between the combustion chamber wall and the dividing wall and also in the region between the dividing wall and the intermediate wall to prevent the walls from contacting one another completely after they have been pushed together and the work device is in its initial position.

These spacer elements and the exhaust gas duct ensure that the residual burned gases can, for practical purposes, be completely removed from the combustion chamber leaving only a negligible portion.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
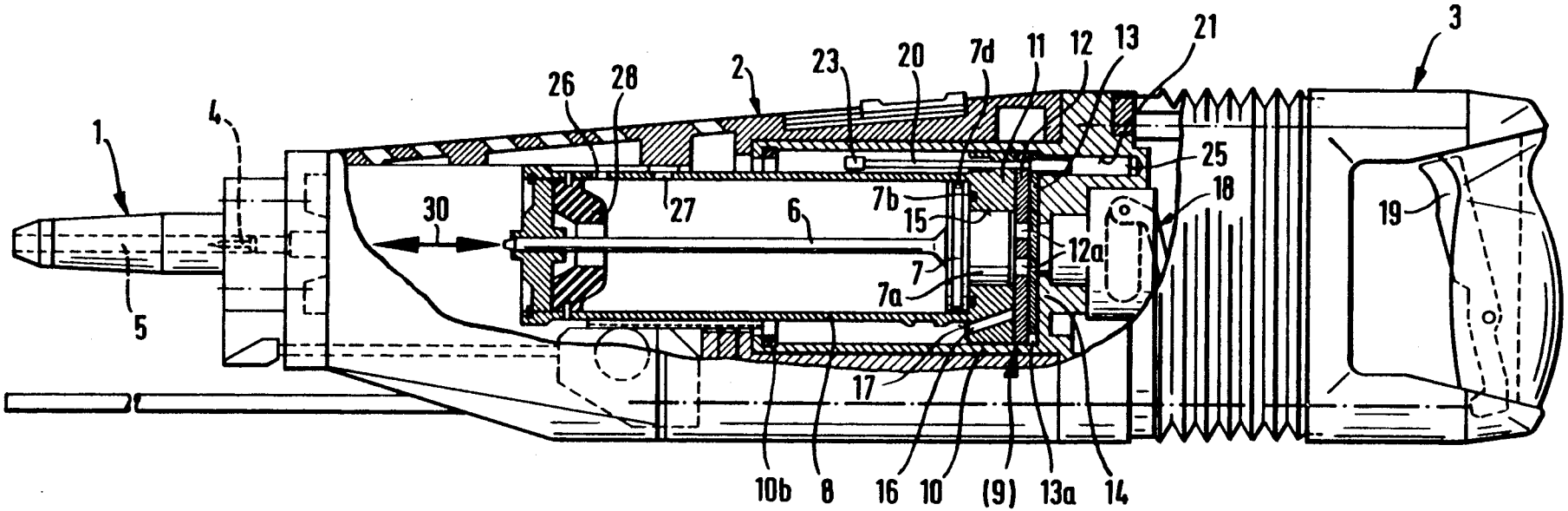
FIG. 1 is an overall schematic view of the work device embodying the present invention as viewed from the side with a part of the device shown in section and in the initial position, that is, ready to commence the internal combustion cycle.

Fastening elements, such as nails, bolts and the like, can be driven directly into receiving materials, such as wood, steel, concrete and the like, by a work device embodying the present invention. As viewed in the drawings the setting direction of the fastening elements is to the left, accordingly, the front of the various parts face toward the left and the rear of such parts face toward the right.

As shown in FIG. 1, the work or setting device has a first housing part 2 with an axially extending muzzle part 1 projecting outwardly from its front end and with a second housing part 3 extending rearwardly from its rear end. The second housing part 3 includes a handle for the device. When a fastening element 4, such as a nail, is to be driven, the front end of the muzzle part 1 is placed against the surface of a structural member, not shown, so that the fastening element can be driven into the structural member. The fastening element 4 is located in an axially elongated barrel 5 extending in the setting direction within the muzzle part 1. During the driving operation, the head end of the fastening element is propelled by a hammer 6 securely connected to a piston 7. Note in FIG. 1 the hammer 6 extends axially from the piston 7. Piston 7 is guided, via piston sealing rings **7*d*, within an axially extending guide cylinder 8 displaceable supported within the first housing part 2 for movement in the setting direction 30**, note the double headed arrow.

A combustion chamber 9 is located at the rear end region of the guide cylinder 8 and serves to drive the piston inside the guide cylinder. Combustion chamber 9 is cylindrically shaped and is held in a stationary position within the first housing part 2. The combustion chamber 9 has a cylindrical combustion chamber housing 10 extending axially in the setting direction 30 and a piston-side annular combustion chamber wall 11 is located at the rear end of the guide cylinder 8 and has an opening 15 closed in FIGS. 1 and 2 by a rearwardly extending projection **7*a*. On the rearward side of the annular combustion chamber wall 11 there is an axially movable dividing wall 12 having openings and another axially movable intermediate wall 13. At its rear end, the cylindrical combustion chamber housing is closed by a rear wall 14 The walls 11, 12, 13 extend transversely of the axis of the combustion chamber housing 10 and are parallel with the rear wall 14** and are movable forwardly and rearwardly away from and towards the rear wall.

Combustion chamber wall 11 has its central through opening 15 closed by the piston projection **7*a* on its front or piston side. The projection 7*a* extends from the piston and is provided with grooves 7*c* in its radially outer surface. Permanent magnets 7*b* can be arranged at the rear face of the piston 7 or in the combustion chamber wall 11 for temporarily holding the piston 7 at the combustion chamber wall 11. Combustion chamber wall 11 has a radially outer wall surface with circumferentially extending seals 31 with the seals in close contact with the inwardly facing wall surface 10*c* of the cylindrical combustion chamber housing 10. Movement of the combustion chamber wall 11 in the setting direction 30 towards the muzzle part 1 is limited by a stop 10*a* projecting inwardly from the inner wall surface 10*c* of the combustion chamber housing 10. An elastic ring 10*b* bears against the stop 10*a* so that the combustion chamber wall 11 is damped when it contacts the elastic ring. In addition to the central through opening 15, the combustion chamber wall 11 has an exhaust gas duct 16 closable by a check valve 17 located at the front side of the wall. This check valve 17 only permits gas to exit from the combustion chamber 9 when the combustion chamber wall 11 is displaced in the setting direction, as shown in FIG. 3**.

Figure 3:
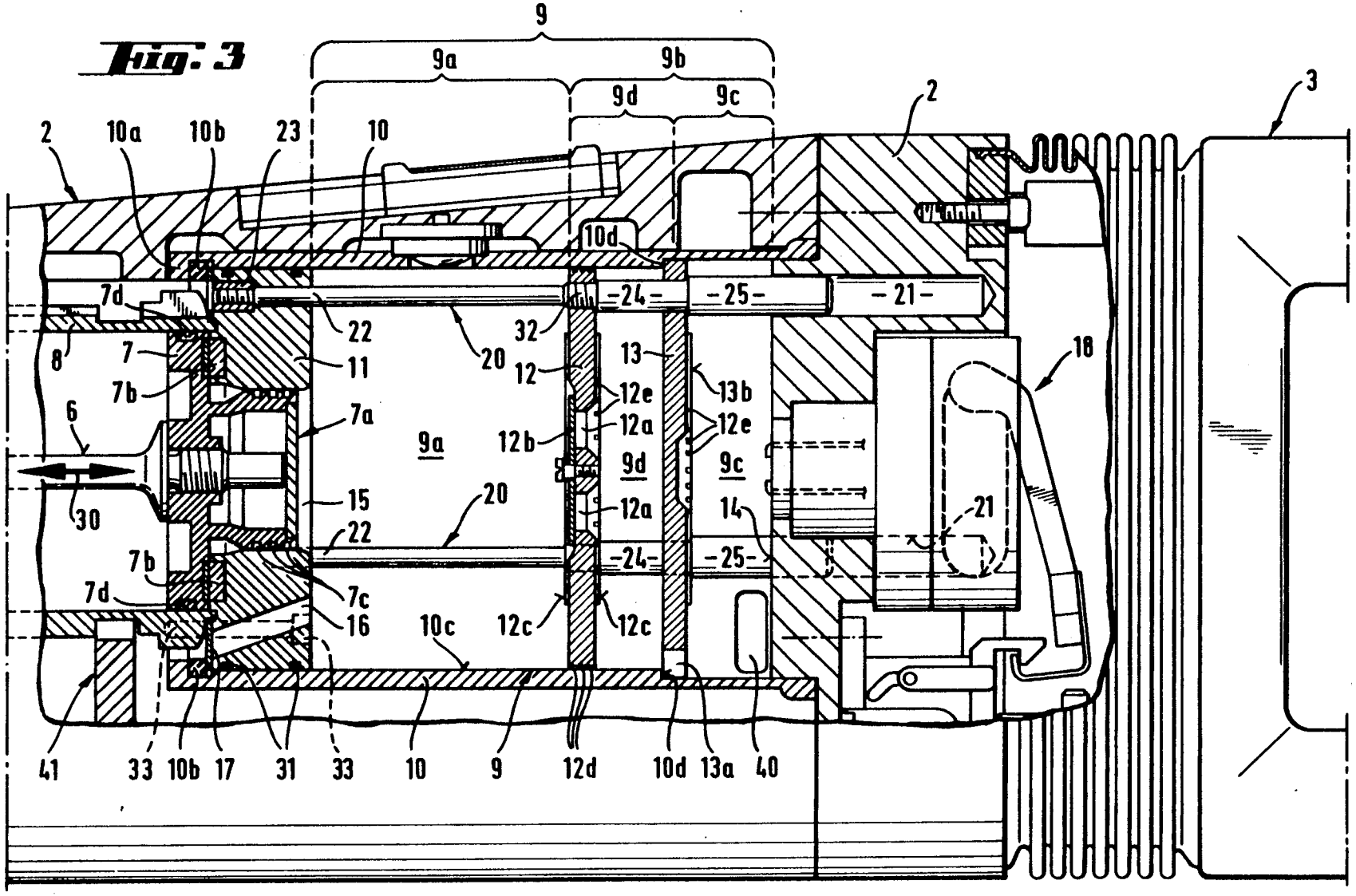
FIG. 3 is a view similar to FIG. 2, however, the combustion chamber volume has been expanded and the chamber walls displaced in the setting direction.

Dividing wall 12 separates the combustion chamber 9 into a front partial combustion chamber **9*a*, closer to the muzzle part, and a rear partial combustion chamber 9*b*, note FIG. 3. The dividing wall 12 closely contacts the inner wall surface 10*c* of the combustion chamber housing 10 around its outer circumferential surface via labyrinth-forming grooves 12*d* and has one or more openings 12*a* in the inner region of the wall closed by a check valve in the form of a resilient valve plate 12*b* on the front side of the wall. Valve plate 12*b* contacts the front side of the dividing wall 12 and can be lifted off such surface toward the combustion chamber wall 11** to a predetermined extent.

Dividing wall 12 and check valve **12*b* supply an air-fuel mixture, already ignited in the rear partial chamber 9*b*, into the front partial combustion chamber 9*a*** in a radial manner as far as possible, so that the air-fuel mixture in the front chamber can burn in an optimum manner. This feature is disclosed in U.S. Pat. No. 4,365,471.

The dividing wall 12 has a spacer stop collar **12*c* on both its front and rear surfaces acting as spacer elements with radial slots 12***e*. The slots also serve to ensure a sufficient venting of the individual chambers when the walls 11, 12, 13 are pushed together acting as venting ducts between the walls.

An intermediate wall 13 is located in the combustion chamber 9 and divides the rear partial chamber into a first rear partial chamber 9*c* and a second rear partial chamber 9*d*. Intermediate wall 13 is located between the dividing wall 12 and the rear wall 14 and has through ducts 13*a* at its circumferential region so that the first rear partial chamber 9*c* communicates with the second rear partial chamber 9*d* via the through ducts 13*a*. A plurality of such through ducts 13 can be arranged equangularly spaced apart around the Circumference of the intermediate wall, though only one of the ducts is shown.

An igniting mechanism 18 is located in the rear wall 14 for igniting of the air-fuel mixture first in the first rear partial chamber 9*c* when a trigger lever 19 in the handle 3 of the device is actuated. Spacer elements 13*b* can be located on the rear surface of the intermediate wall 13 or on the rear wall 14. In general, the spacer elements also serve to prevent the individual walls from sticking together due to residual moisture.

A plurality of guide rods 20 are located within the combustion chamber 9 for guiding the walls 11, 12, 13 with three guide rods spaced equingularly apart in the outer circumferential region of the cylindrical combustion chamber housing 10, The rods 20 extend parallel to the setting direction and to the axial direction of the combustion chamber 9. Guide rods 20 are slidingly supported in cylindrically shaped recesses located within the rear wall 14 and the rods are displaceable in the axial direction. Dividing wall 12 is securely connected axially with the guide rods 20 by a threaded arrangement 32 located approximately in the middle region of the rods between the ends thereof. As a result, guide rods 20 and dividing wall 12 are displaceable together in the setting direction 30 and in the axial direction of the combustion chamber housing 10. Combustion chamber wall 11 is slidably supported on front parts 22 of the guide rods 20 and the front parts 22 extend through corresponding bore holes in the circumferential region of the combustion chamber wall 11. Threaded sleeves 23 are located in widened parts of the combustion chamber wall 11 on the front side of the wall and prevent the combustion chamber wall 11 from sliding off the front part 22 of the guide rods 20. The combustion chamber wall 11 can be displaced along the front part 22 of the guide rods, that is, in the axially extending region of the rods between the threaded sleeves and the dividing wall 12.

Figure 2:
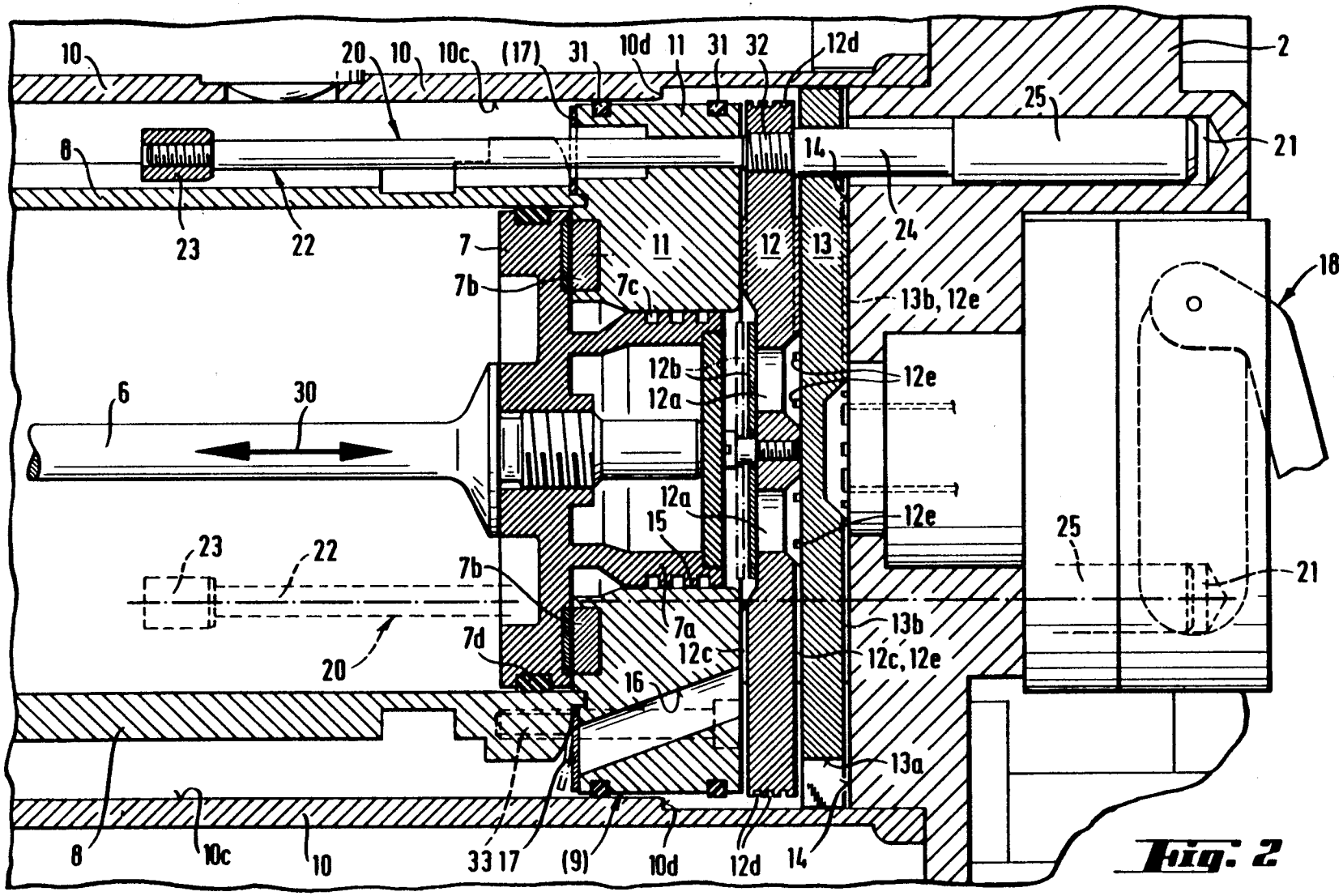
FIG. 2 is an enlarged partial sectional view of the combustion region with the combustion chamber walls shown in the initial position.

Intermediate wall 13 is also slidably displaceable on the guide rods 20, specifically on a guide rod part 24 extending in FIG. 2 within the rear wall 14 and in FIG. 3 located forwardly of the rear wall. Guide rod part 24 extends rearwardly from the thread arrangement 32. The guide rod parts 24 pass through openings in the circumferential region of the intermediate wall 13. The spacing between the dividing wall 12 and the intermediate wall 13 is determined by a guide rod part 25 having a larger diameter than the part 24. Guide rod part 25 is slidably supported in the cylindrical recess 21, note FIGS. 2 and 3. Displacement of the intermediate wall in the forward direction toward the muzzle part is limited by a stop 10*d* formed in the inner surface 10*c* of the combustion chamber housing 10. Combustion chamber housing 10 has a greater inner diameter rearwardly from the stop 10*c* than the forward part of the inner surface.

Displacement of the walls 11, 12, 13 and of the guide rods 20 is effected by a displacement of the guide cylinder 8 with the rear end of the guide cylinder securely connected to the front end of the combustion chamber wall 11 by means of screws 33, shown in dashed lines. Accordingly, if the guide cylinder 8 is displaced in the driving direction 30, the combustion chamber wall 11 also moves in the same forward direction. Therefore, a part of the guide cylinder 8 can be moved coaxially within the combustion chamber 9.

The operation of the work or setting device embodying the present invention is explained in more detail as follows.

First, it is assumed that the work device is in its initial position as shown in FIG. 2. In this initial position, a large axially extending part of the guide cylinder is located inside the combustion chamber, and the combustion chamber wall 11, the dividing wall 12, the intermediate wall 13 and the rear wall 14 for practical purposes contact one another. In this condition, the volume of the combustion chamber 9 is approximately zero apart from small recesses and the venting ducts.

If a suitable mechanical device, not shown, of the guide cylinder 8 is moved forwardly towards the muzzle part 1, the combustion chamber wall 11 is first displaced towards the muzzle part 1 until it strikes against the widened parts 23 on the guide rods 20. With further movement of the guide cylinder 8 in the forward direction, the guide rods 20 and the dividing wall 12 are displaced forwardly. Next, the intermediate wall 13 is moved in the direction of the muzzle part carried along by the guide rod part 25 having the largest diameter, that is at the rear end of the rod. The movement of the walls 11, 12, 13 in the direction of the muzzle part continue until the combustion chamber wall bears against the elastic ring 10*b* with the simultaneous closing of the one-way valve 17. One-way 17 is closed securely when the combustion chamber wall 11 presses against the elastic ring 10*b*. Moreover, the movement of the intermediate wall 13 towards the muzzle part 1 is limited by the stop 10*d* formed by the reduced diameter of the forward part of the inner wall 10*c* of the combustion chamber housing 10.

When the guide chamber 8 and the walls 11, 12, 13 are displaced forwardly from the initial position shown in FIG. 2 into the position shown in FIG. 3, a combustion chamber volume is opened up between the walls 11 and 12, 12 and 13, and 13 and 14, whereby an air-fuel mixture is drawn into the entire combustion chamber first through a opening 40 in the first rear partial chamber 9*c* due to the development of vacuum pressure. Thus, the air-fuel mixture first flows into the first rear partial chamber 9*c* and then into the second rear partial chamber 9*d*. Due to the prevailing pressure conditions, check valve 12*b* in dividing wall 12 opens, whereby the air-fuel mixture also flows into the front partial combustion chamber 9*a*.

Guide cylinder 8 is blocked at 41 from further forward movement after the combustion chamber volume is in the completely opened state, so that the cylinder can not move in the or rearward directions. The air-fuel mixture in the first rear partial chamber 9*c* is ignited by the ignition device 18 when the trigger lever is actuated, the flame front in the first rear partial chamber 9*c* spreads radially outwardly and reaches the second rear partial chamber 9*d* via the through ducts 13*a* with the air-fuel mixture in the rear partial chambers and in the front partial chamber 9*a* being precompressed. The flame front reaches the check valve 12*b* and flows into the front partial combustion chamber 9*a* through the valve opening, so that the air-fuel mixture in such chamber is ignited in an explosive manner.

As a result, the piston 7 is accelerated forwardly within the guide chamber 8 towards the muzzle part 1, whereby the hammer 6 drives the fastening element 4 out of the barrel 5 into the structural member.

Air located ahead of the piston 7 within the guide cylinder 8 flows out through openings 26, 27 in the forward end region of the guide cylinder, so that the piston is not braked by means of an air cushion. If excess energy is developed, such as in relatively soft structural members, the piston 7 strikes against an elastic braking device 28 located at the front end of the guide cylinder 8, note FIG. 1.

The axial distance, that is in the setting direction 30, between the openings 26, 27 is greater than the axial length of the piston 7, whereby when the piston 7 has moved over the opening 27 combustion gas in the combustion chamber and in the rear part of the guide cylinder 8 can escape through the rear openings 27. As a result, residual exhaust gas energy is directed into the atmosphere through the openings 27.

As a result of the expansion of the exhaust gas mixture, the combustion chamber cools down, so that a vacuum pressure is produced drawing the piston 7 in the rearward direction towards the combustion chamber wall 11. During this procedure, the combustion chamber is sealed against the outside.

After the through opening 15 in the combustion chamber wall 11 has been closed again by the piston 7, or by the projection 7*a* with the grooves 7*c* extending axially rearwardly from the piston, the guide cylinder is unlocked, whereby it can be displaced in the axial direction opposite to the setting direction. The guide cylinder 8 is displaced in the rearward direction by the above mentioned mechanical device, not shown, so that the combustion chamber wall 1 is moved first on the guide rods 20 and carries with it the piston 7 due to the magnets 7*b*. The one-way valve opens with the commencement of the displacement of the combustion chamber wall 11 with exhaust gas escaping from the combustion chamber 9 via the exhaust gas duct 16. When the combustion chamber wall 11 is moved further rearwardly, the volume of the front partial combustion chamber 9*a* is reduced until the combustion chamber wall 11 strikes against the dividing wall 12 and displaces the dividing wall in the rearward direction. The guide rods 20 are also displaced toward the rear effecting a reduction in the volume of the second partial rear chamber 9*d*. After the dividing wall 12 contacts the intermediate wall 13, the volume of the first rear partial chamber 9*c* is also reduced leaving a combustion chamber volume at least approximately zero. Exhaust gas from the first rear partial chamber 9*c* is pressed into the front partial combustion chamber 9*a*, or directly into the exhaust gas duct 16 if the combustion chamber wall 11 is already in contact with the dividing wall 12, via the through ducts 13*a* and the venting ducts at the opposite side of the dividing wall 12. The check valve 12*b* can still open even though both walls 11, 12 are in contact with one another.

The combustion chamber 9 can be flushed mechanically as a result of the walls 11, 12, 13 moving toward the end wall 14, without requiring an additional flushing air flow, since the production of such air flow would require additional energy and, therefore, would reduce the efficiency of the work device.

While specific embodiments of the invention have been shown and described in detail to illustrate the application of the inventive principles, it will be understood that the invention may be embodied otherwise without departing from such principles.

We claim:

1. Portable, internal combustion powered work device, such as a setting device for driving fastening elements into a receiving material, comprising an axially extending combustion chamber (9) for receiving and igniting therein an air-fuel mixture, an axially extending piston (7, 7*a*) guided in the axial direction thereof in an axially extending guide cylinder (8) located within and axially displaceable relative to said combustion chamber, wherein the improvement comprises means (11,12,13,20) in said combustion chamber (9) for reducing the volume thereof to approximately zero after the air-fuel mixture introduced into the combustion chamber is ignited and drives said piston, said means comprising movable combustion chamber wall parts (11, 12, 13) extending transversely of the axis of said combustion chamber (9) and displaceable toward a rear wall (14) of said combustion chamber for reducing the volume thereof.

2. Portable internal combustion power work device, as set forth in claim 1, wherein said combustion chamber wall parts (11, 12, 13) comprise an annular combustion chamber wall (11) having an axially extending through opening (15) and said piston (7, 7*a*) is movable toward said annular combustion chamber wall for reducing the combustion chamber volume.

3. Portable, internal combustion powered work device, as set forth in claim 2, wherein at least one displaceable dividing wall (12, 13) is located between said annular combustion chamber wall (11) and said rear wall (14) arranged for movement toward said rear wall for reducing the combustion chamber volume.

4. Portable, internal combustion powered work device, as set forth in claim 3, wherein said annular combustion chamber wall (11) and a pair of said dividing walls (12, 13) are axially displaceable in a cylindrical housing (10) laterally limiting said combustion chamber (9) with said walls displaceable in the axial direction of said housing (10) toward the rear wall (14) opposite to a setting direction (30) for reducing the volume of the combustion chamber (9).

5. Portable, internal combustion powered work device, as set forth in claim 4, wherein the annular combustion chamber wall (11) and the dividing walls (12, 13) are guided in the axial direction by axially extending guide rods (20) located within and extending in the axial direction of said cylindrical housing (10), said guide rods are located in the radially outer circumferential region of said walls, a first said dividing wall (12) located closer to said annular combustion chamber wall (11) is securely connected with said guide rods (20), said annular combustion chamber wall (11) and a second said dividing wall (13) located between said first dividing wall (12) and said rear wall (14) is displaceable relative to said first dividing wall (12) into contact with stops (23, 25) on said guide rods (20), and said guide rods (20) are displaceable in the axial direction of said cylindrical housing (10) of said combustion chamber (9).

6. Portable, internal combustion powered work device, as set forth in claim 2, wherein holding devices (7*b*) are arranged for temporarily holding said piston (7, 7*a*) at a surface of said annular combustion chamber wall (11) facing said piston.

7. Portable, internal combustion powered work device, as set forth in claim 2, wherein said annular combustion chamber wall (11) is securely connected with said guide cylinder (8) and is displaced by said guide cylinder by an actuating force after said annular combustion chamber wall (11) has been closed by said piston (7, 7*a*).

8. Portable, internal combustion powered work device, as set forth in claim 2, wherein said annular combustion chamber wall (11) has at least one exhaust gas duct (16) extending therethrough for flowing exhaust gas out of the combustion chamber (9) when the displaceable annular combustion chamber wall (11) is displaced toward the rear wall (14) for reducing the combustion chamber volume.

9. Portable, internal combustion powered work device, as set forth in claim 2, wherein spacer elements (12*c*, 13*b*) are provided on at least certain facing surfaces of said annular combustion chamber (11) and said dividing walls (12, 13) for preventing said walls (11, 12, 13) from surface contact With one another.

* * * * *